United States Patent [19]

Piretti

[11] 3,944,281

[45] Mar. 16, 1976

[54] MODULAR MEMBERS FOR COMPOSING PIECES OF FURNITURE, AS PADDED CHAIRS, EASY-CHAIRS, DIVANS AND DIVANS CONVERTIBLE IN BEDS

[76] Inventor: Giancarlo Piretti, Via Siepelunga 38/2°, Bologna, Italy, 40141

[22] Filed: July 18, 1974

[21] Appl. No.: 489,729

[52] U.S. Cl. ..... 297/440; 297/248

[51] Int. Cl.[2] ..... A47C 7/00

[58] Field of Search ..... 297/440, 443, 445, 248; 312/108, 111

[56] References Cited

UNITED STATES PATENTS

| | | | |
|---|---|---|---|
| 3,011,227 | 12/1961 | Vogel | 297/248 |
| 3,669,494 | 6/1972 | Lohmeyer | 297/440 |
| 3,773,329 | 11/1973 | Secter | 297/440 UX |
| 3,811,728 | 5/1974 | Redemske | 297/440 |
| 3,822,079 | 7/1974 | Probber | 297/440 X |
| 3,827,751 | 8/1974 | Wiberg | 297/440 |
| 3,834,776 | 9/1974 | Becker | 312/108 |

*Primary Examiner*—James C. Mitchell

[57] ABSTRACT

Modular parallelepiped members for composing disassemblable pieces of furniture as padded chairs, easy chairs, divans and the like comprising a first main modular member having a square open base and a height less than the base side length, a second main modular substantially identical to said first, said second modular member having an open rectangular base; and a third main member having a square open base the length of the sides thereof being equal to the height of the first main member, each main modular member comprising an inner carrying box-like rigid outwardly padded and lined structure, at least the lower portion of which has a horizontal rectangular cross section, and inwardly extending with vertical channels arranged having lower open ends spaced away from the floor plane, each channel being positioned so as to be distant from the closest vertical corner of the modular member of a value which is equal to ¼ of the length of the side of the square base of the first modular member, said modular members being connectable in a disassemblable manner to each other by U-like clamps or stirrups which are introduced into pairs of two aligned channels of two adjacent modular members.

7 Claims, 15 Drawing Figures

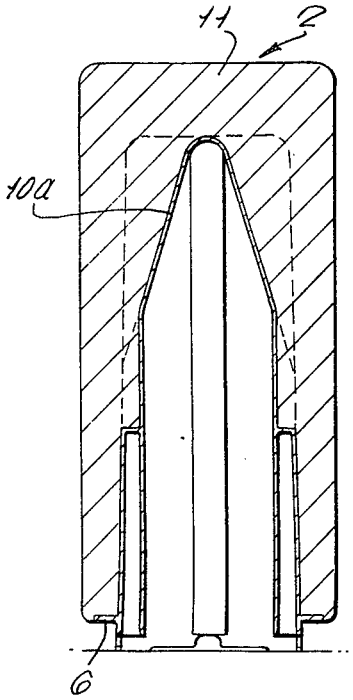
FIG. 5.
FIG. 6.
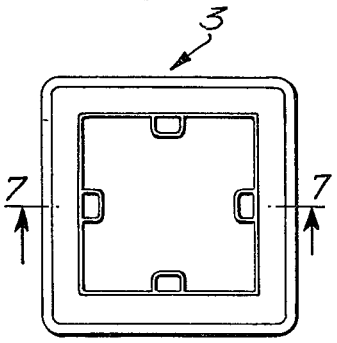
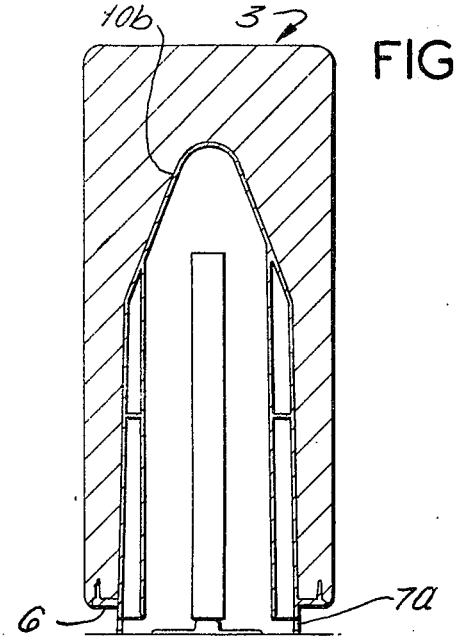
FIG. 7.
FIG. 8.
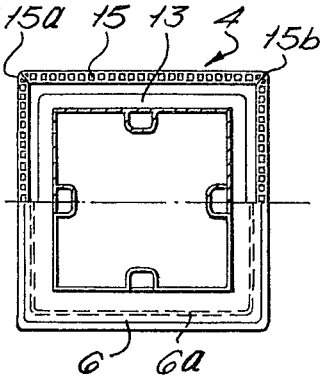

MODULAR MEMBERS FOR COMPOSING PIECES OF FURNITURE, AS PADDED CHAIRS, EASY-CHAIRS, DIVANS AND DIVANS CONVERTIBLE IN BEDS

The present invention relates to a plurality of prefabricated modular members, ready to be used and each comprising an inner box-like rigid body, padded on its outer surfaces and covered by a lining and optionally including spring means, said members having a substantially parallelepiped shape with a rectangular or square open base for the insertion of connection means in the form of removable U-clamps or stirrups adapted to connect said modular members to each other according to different configurations so as to obtain pieces of furniture of various patterns as well as of different intended purposes, as chairs, easy-chairs, divans, divans convertible into beds and the like which can be readily disassembled and then assembled again in different models of pieces of furniture. Said main modular members may be also connected to other auxiliary modular members constructed according to the same principle, but having particular purposes.

On the inside of each of the modular members vertical housings are provided having lower open ends, each adapted to receive one of the two vertical parallel arms of the U-clamps, said housings being positioned so as to enable the assembling of different pieces of furniture using said U-clamps, and also assembling of each modular member in different positions and dispositions. In this manner, a visible side or front surface of a modular member may be changed with another surface thereof, when said visible surface has been worn with use or has been damaged or for any other occasional reason, thus increasing the life during which the piece of furniture can be kept in a thoroughly efficient condition.

The modular members of this invention comprise main members of three types, i.e. a first modular member having a square open base and a height less than the length of the base sides, preferably equal to half of said length, said first member being thus open along one of its widest surfaces, while the opposite square surface is padded and provided with spring means on its outer side, since it is designed to constitute the seat of a chair or easy-chair, or, when it is connected with other similar first members, the seat of a divan or the resting surface of a divan converted into a bed.

The second main modular member has a configuration equal to that of the first modular member and the same dimensions with the exception that the open base is formed of one of its four rectangular surfaces, said second modular member being designed to be used to form the back of a chair or easy-chair, or divan, or the arm-rest sides of an easy-chair or divan, or the head of a divan converted into a bed.

The third modular member has a square open base, the sides of which have a length equal to the shortest dimension of the first and second modular members; also this member has outwardly padded and lined surfaces and serves to provide angled portions in the pieces of furniture.

Along the periphery of their open bases, each of the modular member extends downwardly in a rigid innerwardly recessed board acting as a protective socle so as to maintain the lined and padded surfaces of the pieces of furniture sufficiently spaced away from the floor and out with contact of the dirt on the floor or with the cleaning or polishing means, as well as to protect said outer lined surfaces against the knocks of the user's shoes or of brooms.

According to this invention disassemblable pieces of furniture can be composed by any unskilled person without requiring the use of screws, tools or fixtures. The pieces of furniture are constituted of very simple parallelepiped bodies and are composed by means of two or more modular members, the dimensions of which are equal or submultiple of a basic value so that they can be stored in a minimum space when stacked on each other in their disassembled disposition and in a condition of perfect maintainance, protective or packing means being thus no longer required, for their storage or transport.

These and other objects, advantages and features of the invention will be better understood from the following description of an embodiment of this invention which is shown in the accompanying drawings, in which:

FIG. 5 is a sectional view taken substantially along line 5—5 of FIG. 3;

FIG. 6 is a plan view of a third main modular member constructed in accordance with the principles of the present invention;

FIG. 7 is a sectional view taken substantially along line 7—7 in FIG. 6;

FIG. 8 is a plan view, with parts broken away, of an auxiliary modular member constructed according to the principles of the present invention and adapted to constitute a small table, flower stand or a night table;

Figure 10A:
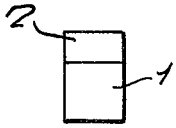
Figure 10B:
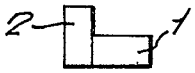
Figure 11A:
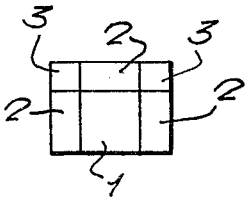
Figure 11B:
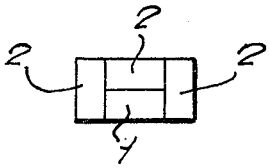
Figure 12:
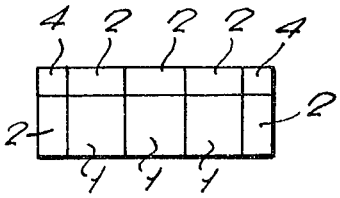
Figure 13:
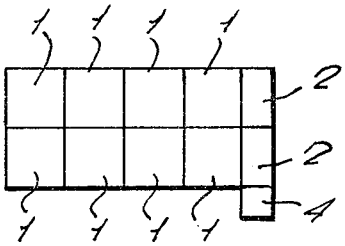

FIGS. 10*a* and 10*b* are schematic plan and elevational views, respectively, of a piece of furniture constructed by the assembly of first and second main modular members;

FIG. 11*a* is a plan view of a piece of furniture formed by assembling first, second and third main modular members;

FIG. 11*b* is a plan view of a piece of furniture formed by assembling first and second main modular members;

FIG. 12 is a plan view of a piece of furniture formed by assembling first, second and auxiliary modular members; and FIG. 13 is a plan view of a piece of furniture formed by assembling first, second and auxiliary modular members.

Now referring to the drawings, the main modular members are generally marked 1, 2 and 3, while 4 indicates an auxiliary modular member.

It is to be noted that the carrying structure of each modular member is substantially the same, only the dimension being varied so that the operatively identical parts will be marked throughout the several Figures by the same numbers or by numbers with indices.

In the shown embodiment the dimensions of the member 1 are: (L × L) × L/2, those of the member 2 are: (L/2 × L) × L, and those of the member 3 are: (L/2 × L/2) × L.

Figure 1:
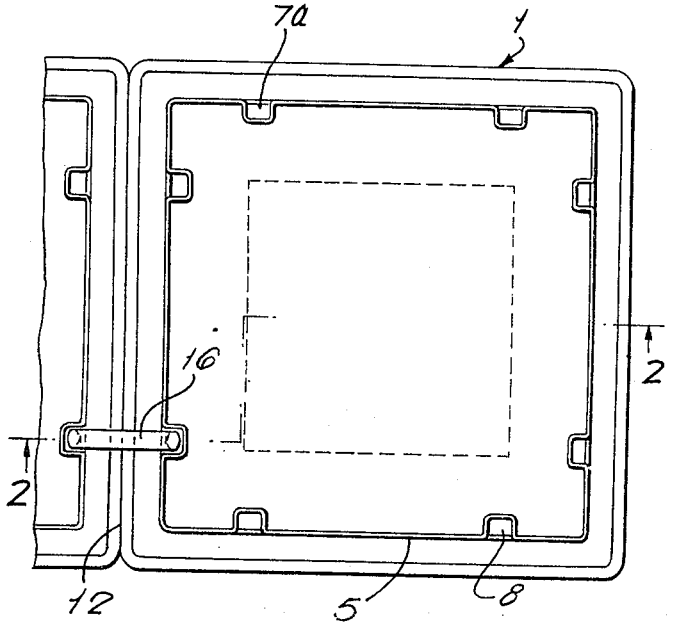
FIG. 1 is a plan view of a first main modular member adjacent to and joined to a similar member (only partially represented)
Figure 2:
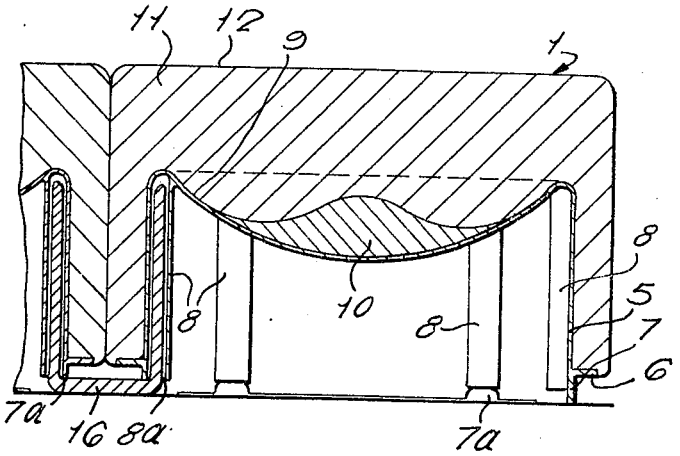
FIG. 2 is a sectional view taken substantially along line 2—2 of FIG. 1.
Figure 3:
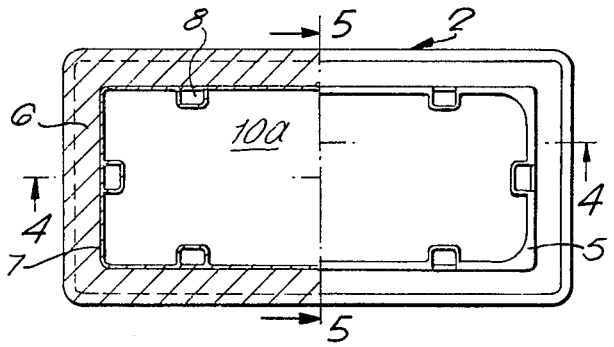
FIG. 3 is a plan view, partially in section taken substantially along line 3—3 of FIG. 4, of a second main modular member constructed in accordance with the principles of the present invention.
Figure 4:
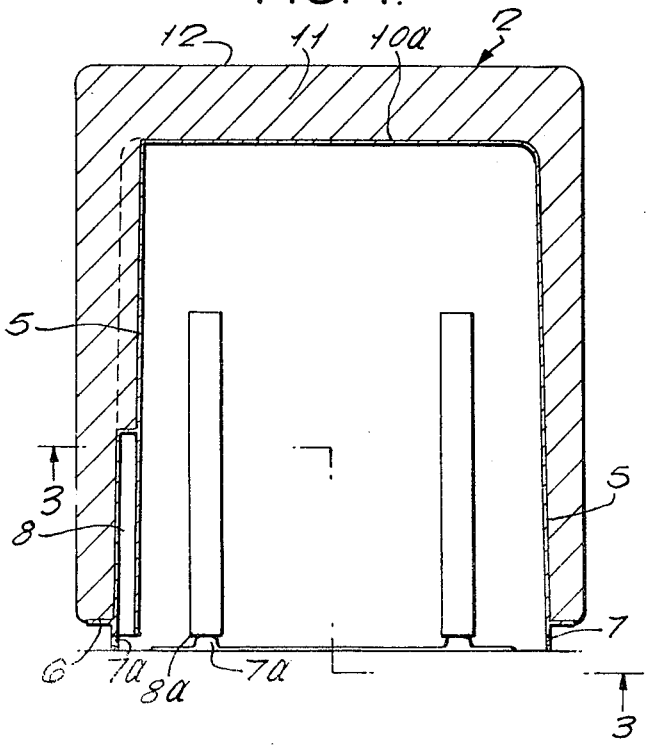
FIG. 4 is a sectional view taken substantially along line 4—4 of FIG. 3.

Now referring to the member 1 shown in FIGS. 1 and 2 it comprises an inner carrying structure which is constituted of a shell or box-like body 5 made of a light-weight, rigid and heat moldable material, as, for instance, plastics, preferably reinforced plastics. Said box-like body 5 has a parallelepiped shape having a square open base and is provided with an outwardly extending peripheral flange 6, and underneath the flange 6 the vertical walls of said body 5 extend downwardly to form spacing socle 7.

At intermediate points of the vertical inner surfaces of said body 5, vertical inner channels 8 are provided having a substantially rectangular cross section and lower open ends 8*a;* of course, said channels 8 could also be of circular cross section or of other suitable form. In each modular member 1, 2 or 3 the channels 8 are positioned in such a manner so as to be spaced away from the nearest vertical corner of this body 5 of a length equal to L/4, where L is the length of the base side of the member 1. As a result thereof each member 1 will have two channels 8 adjacent each vertical wall, the member 2 will have two channels 8 adjacent its longest vertical walls and one channel 8 along the vertical centre line of its shortest walls, and member 3 will have one inner channel on the vertical centre line of each vertical wall. The same configuration will be provided for the auxiliary modular member 4 or in other auxiliary members constructed according to the same principle, but modified at their upper parts according to their particular intended purposes.

In correspondence of each lower open end 8*a* of the channels 8, which is spaced away from the floor at a height equal to the socle height, the socle 7 is provided with recess 7*a* for the passage of the locking clamps which will be hereinbelow described.

In the modular member 1 the box-like inner body has a concave upper surface 9 shaped so as to fit to the anatomic shape of the user's body and upon which is mounted a cushion or bolster 10 made of hardened rubber. About the assembly 5, 9 and 10 is applied a padding of sponge rubber or of foam plastic material 11 forming a sprung, soft layer which is then covered by a lining 12 made of fabric or of a sheet of synthetic material, natural or artificial leather or the like, which is fixed underneath the horizontal peripheral lower flange 6 over the recessed socle 7. If desired, springs or other suitable support means may also be included. The modular member 2 is substantially identical to the member 1, but the rigid box-like inner body 5, 8 forms at its upper part inwardly bent wall portions 10*a* and about said body is applied the padding 11 covered by the lining 12. In the same manner the modular member 3 includes a rigid box-like inner body 5, 8 which at its upper portion forms inwardly bent wall portions 10*b*, said body being covered by the padding 11 and the lining 12.

Figure 9:
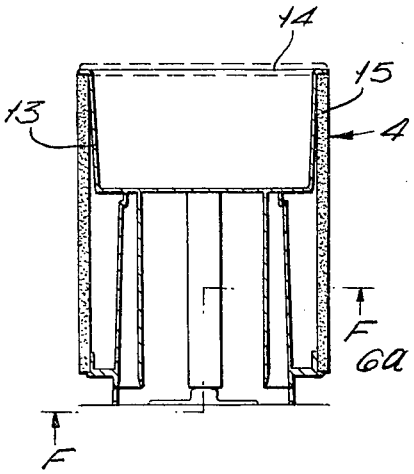
FIG. 9 is a side elevational view, partly in section and with parts broken away, of the auxiliary modular member shown in FIG. 8.

The auxiliary member 4, in the shown embodiment, has the same outline in plan as the member 3, but it could have also the configuration of member 2 or 1 and any desired height; each member 4 will have therefore an inner carrying structure substantially similar to that of the corresponding main members 1, 2 or 3, but at its upper part it is shaped according to the particular intended purpose. For instance, the member 4, as shown in FIG. 9, comprises an upper cavity, to house a container or basin 13, made of steel or other suitable material, when it is intended to receive flower-pots or to be used as a bearing plane for bottles of spirits drinks and the like, in case it is associated with a divan. Said member 4 could be also provided with a removable cover 14 to close said basin 13 so that, in this case, the member 4 can be used as night table after having converted the divan into a bed, (FIG. 13). Of course, in the upper part of each of the auxiliary modular members 4 there can be also provided drawers or open areas of any type so as to enable one to compose independent tables or small tables formed by members 4 connected to each other by the same connection system. Owing to this particular intended purpose, the member 4 is not provided with outer padding means or lining means, unless so desired; but it is laterally covered by panels 15 which can be fixed, for instance, by slidably fitting their edges shaped in complementary form one into another or by any other suitable locking system. The panels 15 may be adhered or fixed in any other suitable manner to an upwardly extending limb 6*a* of the peripheral edge 6 as shown in FIG. 9.

The connecting system between the different modular main members and optionally with one or more of the auxiliary members 4 is very simple. For such a purpose strong U-shaped clamps 16 (FIGS. 1 and 2) are provided which are introduced through the recesses 7*a* of the socle 7 so that their parallel long arms are introduced through the open ends 8*a* into the channels 8. The height of the recesses 7*a* is such that the clamps 16 in assembled position do not contact the floor. Said clamps or stirrups 16 can be inserted with force into said channels 8, owing to the resiliency of the padded side walls of the modular members 1 to 3 which contact one another, thus providing a stable connection of said members and forming a piece of furniture which can be raised or shifted without any risk that the component members can be separated from each other owing to the resiliently forced connection and to the considerable length of the parallel arms of the U-like clamps 16. After the assembling has been performed, it is then sufficient to apply a traction on the transverse arm of each clamp 16, to remove this latter from the channel 8 associated therewith: in such a manner each piece of furniture can be disassembled and its components can in turn be connected again to each other or to other different modular members so as to form a piece of furniture of a different pattern. Further each front or side surface of the members 1, 2, 3 which is in sight can be turned in such a manner as to face another surface, when said surface has become soiled, or is torn or the like. In this manner the piece of furniture looks again as it would be a new piece of furniture and that is a very advantageous, in particular in the case of the front wall portions against which the users feet commonly knock.

FIGS. 10a to 13 diagrammatically show different pieces of furniture composed with the modular members of the invention. FIGS. 10*a* and 10*b* show a padded chair in a top view and in side view, respectively; FIGS. 11*a* and 11*b* show a top view and a front view of a easy chair, respectively; FIG. 12 is a top view of a divan including angle auxiliary members 4 which may have the role of flower-stands, while FIG. 13 is a top view of a bed associated with an auxiliary member 4 used as a night-table.

The compositions which can be obtained by the use of said modular members are varied as well as the patterns and models obtained thereby, since several modular members could also be connected to each other which have coverings of different colors and/or kinds.

I claim:

1. A set of modular members for removably assembling pieces of furniture, said set comprising:

a first main modular member having a square open base and a height less than the base side length;

a second main modular member substantially identical to said first modular member but having two vertical parallel walls having the same dimensions as those of the first member and an open rectangular base;

a third main modular member having a square open base with the length of the sides thereof being equal to the height of said first main member, each of said main modular members comprising an inner box-like substantially rigid supporting structure, of which at least the lower portion has a substantially horizontal rectangular cross section, a plurality of spaced substantially vertical channels projecting inwardly and located on the inner walls of said supporting structure, said channels having lower open ends spaced above the plane of the floor supporting the member, the outer surface of the supporting structure being covered by a padding material with an outer flexible cover; and substantially U-shaped clamps adapted to be introduced from the bottom into two aligned channels of two adjacent modular members to removably connect the modular members.

2. A set of modular members according to claim 1 wherein said channels are spaced from the corners of each member by a distance approximately equal to one-fourth of the length of a side of the square base of said first modular member.

3. A set of modular members according to claim 1, which further comprises auxiliary modular members having upper portions so shaped as to be adapted to serve as accessory pieces to said first, second and third modular members.

4. A set of modular members according to claim 1 wherein the support structure extends downwardly with a socle, the lower edge of which is provided with recesses arranged in alignment with the lower open ends of said vertical channels so as to be adapted to receive the lower central portion of the U-shaped connecting clamps, the parallel arms of which are received into said channels, each supporting structure having a horizontal peripheral outwardly extending flange above its socle to support the padded material at its lower portion and to receive underneath the edge of the cover for fixing it in place.

5. A set of modular members according to claim 3 wherein the auxiliary members are provided with side panels.

6. A set of modular members according to claim 3, wherein the auxiliary members are provided at their upper ends with removable covers and with drawers and spaces accessible from the outside.

7. A set of modular members according to claim 1, wherein the first member has the dimensions: $(L \times L) \times L/2$, the second modular member has the dimensions: $(L \times L/2) \times L$, and the third modular member has the dimensions: $(L/2 \times L/2) \times L$.

* * * * *